US011686207B2

(12) United States Patent
Brignole et al.

(10) Patent No.: US 11,686,207 B2
(45) Date of Patent: Jun. 27, 2023

(54) GAS TURBINE COMPRESSOR

(71) Applicant: MTU Aero Engines AG, Munich (DE)

(72) Inventors: Giovanni Brignole, Munich (DE); Tobias Mayenberger, Munich (DE)

(73) Assignee: MTU Aero Engines AG, Munich (DE)

( * ) Notice: Subject to any disclaimer, the term of this patent is extended or adjusted under 35 U.S.C. 154(b) by 86 days.

(21) Appl. No.: 16/286,780

(22) Filed: Feb. 27, 2019

(65) Prior Publication Data

US 2019/0277152 A1 Sep. 12, 2019

(30) Foreign Application Priority Data

Mar. 6, 2018 (DE) ..... 102018203304.8

(51) Int. Cl.
*F01D 11/08* (2006.01)
*F04D 29/52* (2006.01)
*F04D 29/68* (2006.01)

(52) U.S. Cl.
CPC ..... *F01D 11/08* (2013.01); *F04D 29/526* (2013.01); *F04D 29/685* (2013.01); *F05D 2240/126* (2013.01); *F05D 2240/55* (2013.01)

(58) Field of Classification Search
CPC ..... F01D 11/08; F04D 29/526
See application file for complete search history.

(56) References Cited

U.S. PATENT DOCUMENTS

| | | | |
|---|---|---|---|
| 7,186,072 B2 | 3/2007 | Seitz et al. | |
| 8,251,648 B2 * | 8/2012 | Johann | F04D 29/321 415/173.1 |
| 8,257,022 B2 | 9/2012 | Guemmer | |
| 2004/0156714 A1 | 8/2004 | Seitz | |
| 2008/0206040 A1 | 8/2008 | Seitz | |
| 2015/0285079 A1 | 10/2015 | Brignole et al. | |

FOREIGN PATENT DOCUMENTS

| | | |
|---|---|---|
| DE | 10330084 B4 | 6/2010 |
| DE | 102007056953 B4 | 10/2015 |
| EP | 2143956 A2 | 1/2010 |
| EP | 2927503 A1 | 10/2015 |
| EP | 2927503 A1 | 10/2015 |
| WO | WO2004018844 A1 | 3/2004 |

* cited by examiner

*Primary Examiner* — Michael L Sehn
(74) *Attorney, Agent, or Firm* — Davidson, Davidson & Kappel, LLC

(57) ABSTRACT

A gas turbine compressor has a flow duct wall disposed radially opposite to an airfoil tip and has a circumferential groove having an upstream groove edge and a downstream groove edge, the circumferential groove having a web having a radial cutback. In at least one meridional section through an airfoil-tip-side end face of the web, an axial distance between an upstream beginning of the cutback and the upstream leading edge of the airfoil tip is at least 1% and/or no more than 40% of a chord length and/or an axial distance between the upstream leading edge of the airfoil tip and the downstream groove edge is at least 5% and/or no more than 40% of the chord and/or an axial distance between the upstream leading edge of the airfoil tip and a kink in an airfoil-tip-side upper edge of the web in the cutback is no more than 10% of the chord length and/or a radial distance between the airfoil tip and an airfoil-tip-side upper edge of the web in the cutback is at least 50% and/or no more than 1500% of a radial distance between the airfoil tip and the downstream groove edge radially opposite thereto.

18 Claims, 1 Drawing Sheet

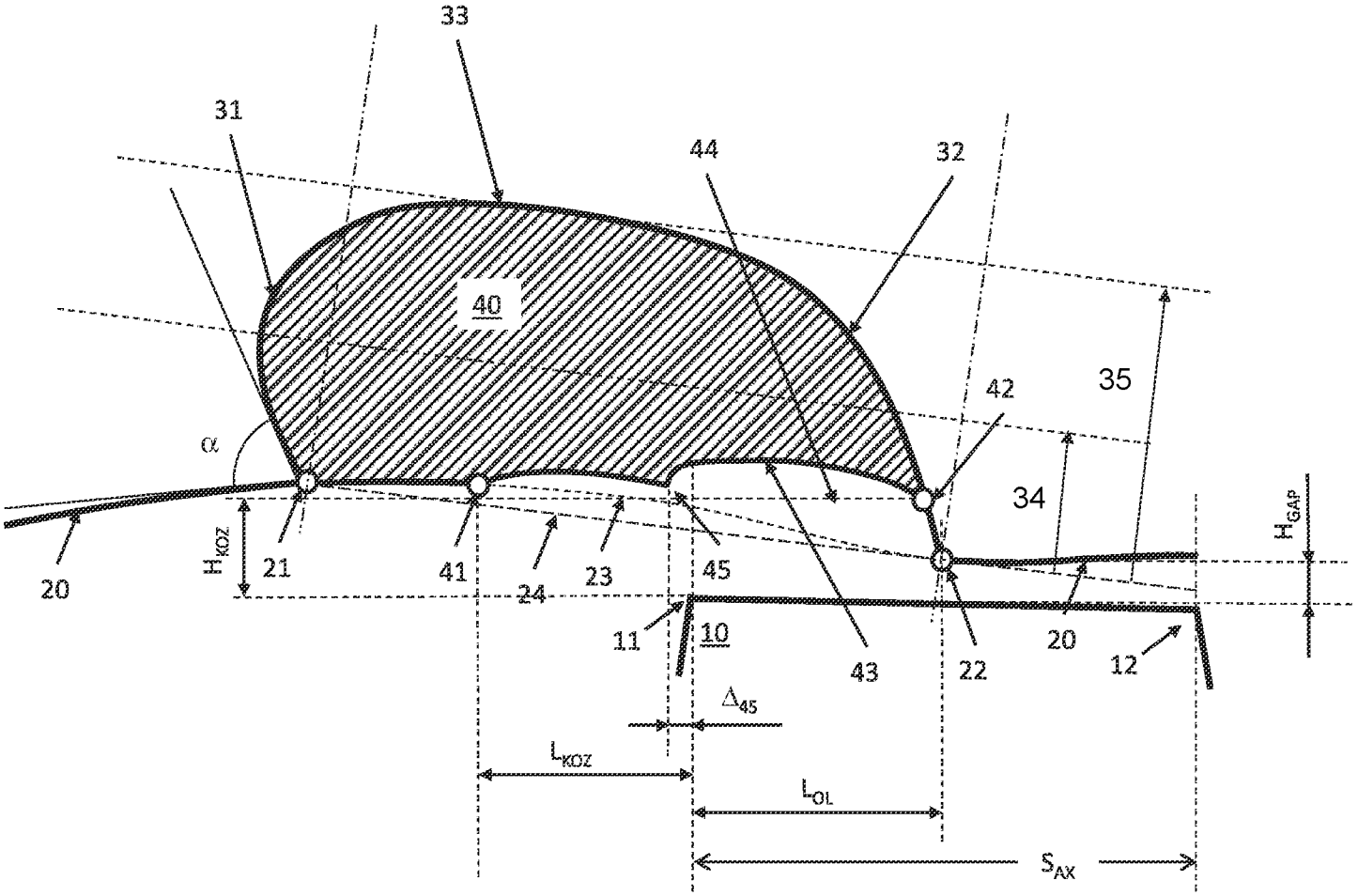
H_GAP
35
34
12
20
S_AK
42
22
32
43
L_OL
44
45
10
Δ_45
11
23
L_KOZ
24
33
40
41
21
31
α
H_KOZ
20

GAS TURBINE COMPRESSOR

This claims the benefit of German Patent Application DE 10 2018 203 304.8, filed Mar. 6, 2018 and hereby incorporated by reference herein.

The present invention relates to a gas turbine compressor and an aircraft engine having such a gas turbine compressor, and to a method for designing such a gas turbine compressor.

BACKGROUND

European Patent Application EP 2927503 A1 describes a gas turbine compressor having airfoil tips which each have an upstream leading edge and a downstream trailing edge, and a flow duct wall which is disposed radially opposite to these airfoil tips and has formed therein a circumferential groove having an upstream groove edge and a downstream groove edge, the circumferential groove having webs arranged therein which each have a radial cutback.

SUMMARY OF THE INVENTION

It is an object of an embodiment of the present invention to improve a gas turbine compressor.

The present invention provides a gas turbine compressor as well as an aircraft engine having a gas turbine compressor as described herein and for also a method for designing a gas turbine compressor as described herein.

In accordance with an aspect of the present invention, a gas turbine compressor, in particular an axial gas turbine compressor, includes one or more airfoils arranged circumferentially adjacent one another and having tips, in particular shroudless tips, and further includes a flow duct wall disposed radially opposite to the airfoil tips.

In one embodiment, the gas turbine compressor is a gas turbine compressor for, or of, an aircraft engine, and may in particular be a low-pressure compressor disposed upstream of another gas turbine compressor or a high-pressure compressor disposed downstream of another gas turbine compressor in a gas turbine. In one embodiment, the airfoils are rotor blades which are arranged on a rotatably mounted rotor and rotate during operation, and the flow duct wall, which is fixed relative to the casing, is located radially outwardly of and opposite to the radially outer airfoil tips. In another embodiment, the airfoils are stator vanes which are fixed relative to the casing, and the rotatably mounted flow duct wall is located radially inwardly thereof and opposite thereto and rotates during operation.

As is customary in the art, in an embodiment, an axial direction is parallel to the axis of rotation of the compressor, a circumferential direction is a direction of rotation about this axis of rotation, and a radial direction is perpendicular to the axial and circumferential directions. As is customary in the art, in an embodiment, the terms "upstream" and "downstream" refer to a (normal) (direction of) flow through the compressor, so that, in an embodiment, "upstream" is closer to an inlet of the compressor and "downstream" is closer to an outlet thereof.

The flow duct wall has a circumferential groove therein. In an embodiment, this circumferential groove has an upstream flank which merges into the flow duct wall at an upstream groove edge, a downstream flank which merges into the flow duct wall at a downstream groove edge, and a groove base connecting these groove flanks. In one embodiment, a groove edge may be sharp, i.e., angled, or rounded, i.e., have a radius. In the latter case, for dimensional specifications, the groove edge may be defined by the center point of its radius or the point of intersection of its two outermost tangents.

In one embodiment, the upstream groove flank and/or the downstream groove flank has/have an axial undercut. In a refinement, the cross-sectional area of the axial undercut in at least one meridional section is less than 10% of a cross-sectional area of the circumferential groove between its upstream and downstream groove edges.

In the context of the present invention, a meridional section is a plane section containing the axis of rotation of the compressor. An axial undercut of the upstream groove flank is a region of this groove flank that is located axially upstream of the upstream groove edge. Correspondingly, an axial undercut of the downstream groove flank is a region of this groove flank that is located axially downstream of the downstream groove edge. A cross-sectional area of the circumferential groove between its upstream and downstream groove edges is accordingly the area which, in a meridional section, is defined by the groove base, a straight connecting line between the upstream and downstream groove edges, and perpendicular lines through the upstream and downstream groove edges.

In one embodiment, the circumferential groove extends in particular continuously or uninterruptedly through the full circumference of the flow duct wall; i.e., through 360°. In other words, in one embodiment, each of the upstream and downstream groove edges is a continuous edge extending uninterruptedly through 360°. In one embodiment, the production and/or the aerodynamics of the circumferential groove can thereby be improved.

The circumferential groove has one or more webs arranged therein. In one embodiment, a plurality of adjacent webs, in particular all webs, may be configured identically, and in particular have at least substantially identical dimensions and contours. In one embodiment, the production and/or the aerodynamics of the circumferential groove can thereby be improved. In one embodiment, adjacent webs may also be configured differently, and in particular have different dimensions and/or contours. In one embodiment, this makes it possible to deliberately produce or compensate for asymmetries. Three or more webs, in particular all webs, may be equidistantly spaced in the circumferential direction. Likewise, three or more webs, in particular all webs, may have pairwise different spacings in the circumferential direction.

One or more webs, preferably all webs, have a radial cutback. As used herein, a "radial cutback" is understood to be in particular an empty space between an airfoil-side end face of the web and its projection into a reference plane extending from the upstream groove edge to the downstream groove edge, the curvature of the reference plane in the meridional sections through the end face being infinite or, at the upstream and downstream groove edges, equal to that of the flow duct wall and axially continuously linear therebetween. Accordingly, in a meridional section, the radial cutback is understood to be the free area between an airfoil-tip-side upper edge of the cross section of the web and a reference curve extending from the upstream groove edge to the downstream groove edge, the curvature of the reference curve being infinite or, at the upstream and downstream groove edges, equal to that of the flow duct wall and axially continuously linear therebetween. In other words, in one embodiment, a "radial cutback" is understood to be the empty space or the free area between the airfoil-side end face or upper edge of the web and a virtual extension of the flow duct contour across the circumferential groove. This virtual extension of the contour may be a straight connecting plane or line or may connect the groove edges with a curvature that corresponds to the curvature of the flow duct contour at the groove edges and interpolates linearly therebetween.

In an embodiment of the present invention, in one or more meridional sections, preferably all meridional sections, through an airfoil-tip-side end face of the web, a distance in the axial direction ("axial distance") between an upstream beginning of the cutback and an upstream leading edge of the airfoil tip is at least 1%, in particular at least 1.5%, in one embodiment at least 2%, and/or no more than 40%, in particular no more than 30%, in one embodiment no more than 15%, of a chord length between the upstream leading edge and a downstream trailing edge of the airfoil tip, and the gas turbine compressor is so designed, and this axial distance is so selected.

Additionally or alternatively, in an embodiment of the present invention, in one or more meridional sections, preferably all meridional sections, through the airfoil-tip-side end face of the web, an axial distance between the upstream leading edge of the airfoil tip and the downstream groove edge is at least 5%, in particular at least 7.5%, in one embodiment at least 10%, and/or no more than 40%, in particular no more than 35%, in one embodiment no more than 30%, of the chord length between the upstream leading edge and the downstream trailing edge of the airfoil tip, and the gas turbine compressor is so designed, and this axial distance is so selected.

Additionally or alternatively, in an embodiment of the present invention, in one or more meridional sections, preferably all meridional sections, through the airfoil-tip-side end face of the web, an axial distance between the upstream leading edge of the airfoil tip and a kink in an airfoil-tip-side upper edge of the web in the cutback is at least 10%, in particular at least 7.5%, in one embodiment no more than 5%, of the chord length between the upstream leading edge and the downstream trailing edge of the airfoil tip, the kink in one embodiment being disposed downstream of the upstream leading edge of the airfoil tip and in another embodiment the kink being disposed upstream thereof, and the gas turbine compressor is so designed, and this axial distance is so selected. In one embodiment, the kink in the airfoil-tip-side upper edge may be sharp, i.e., angled, or rounded, i.e., have a radius. In the latter case, for dimensional specifications, the kink may be defined by the center point of its radius or the point of intersection of its two outermost tangents. What is referred to herein as a kink is, in particular, a (point of) discontinuity in the tangent to the upper edge of the web. In another embodiment, the airfoil-tip-side end face or upper edge of the web in the cutback may also be kink-free.

Additionally or alternatively, in an embodiment of the present invention, in one or more meridional sections, preferably all meridional sections, through the airfoil-tip-side end face of the web, an, in particular minimum, maximum and/or medium, distance in the radial direction ("(minimum/maximum/medium) radial distance") between the airfoil tip, in particular its upstream leading edge, and an airfoil-tip-side upper edge of the web in the cutback is at least 50%, in particular at least 75%, in one embodiment at least 100%, and/or no more than 1500%, in particular no more than 1250%, in one embodiment no more than 1000%, of a radial distance between the airfoil tip and the downstream groove edge radially opposite thereto, and the gas turbine compressor is so designed, and this axial distance is so selected.

Surprisingly, it has been found that in the case of such a "leading portion" of the cutback which leading portion is upstream of the upstream leading edge of the airfoil tip and quantitatively dependent on the chord length of the airfoil tip, such an overlap of the airfoil tip over the circumferential groove which overlap is quantitatively dependent on the chord length of the airfoil tip, and such an axial positioning of a possible kink in the airfoil-tip-side upper edge of the web in the cutback relative to the upstream leading edge of the airfoil tip which axial positioning is dependent on the chord length of the airfoil tip, in each case already alone, in particular in a combination of at least two of these quantitative relationships, the advantages of the casing treatment are at least substantially retained during off-design operation, while at the same time making it possible to reduce unwanted flow phenomena during design operation; i.e., under nominal operating conditions, and, in an embodiment, to further improve the operating characteristics over a gas turbine compressor known from EP 2 927 503 A1.

As is customary in the art, in an embodiment, the term "chord length" denotes the length of the chord line or camber line of the airfoil tip or its projection in the axial direction or the axial distance between the leading and trailing edges of the airfoil tip.

Also surprisingly, it has been found that in the case of such a height of the cutback or radial distance between its upper edge and the airfoil tip which height is quantitatively dependent on the gap height immediately downstream of the circumferential groove, in each case already alone, but in particular in combination with one or more of the aforementioned relationships, the advantages of the casing treatment are at least substantially retained during off-design operation, while at the same time making it possible to reduce unwanted flow phenomena during design operation; i.e., under nominal operating conditions, and, in an embodiment, to further improve the operating characteristics over a gas turbine compressor known from EP 2 927 503 A1.

In an embodiment, in particular in one or more meridional sections, preferably all meridional sections, through the airfoil-tip-side end face of the web, an upstream beginning of the cutback is located axially downstream of the upstream groove edge between this groove edge and the upstream leading edge of the airfoil tip and/or a downstream end of the cutback is located in an airfoil-tip-proximal half of a radial height of the circumferential groove.

Surprisingly, it has been found that in one embodiment, by such a cutback which begins downstream of the upstream groove edge and upstream of the upstream leading edge of the airfoil tip, and which ends in the airfoil-tip-proximal half of the circumferential groove, in combination with one or more of the aforementioned relationships, the advantages of the casing treatment are at least substantially retained during off-design operation, while at the same time making it possible to reduce unwanted flow phenomena during design operation; i.e., under nominal operating conditions.

In one embodiment, an "upstream beginning" of the cutback is understood to be the axial position beyond which the airfoil-side end face or upper edge of the web deviates from the virtual extension of the flow duct contour or the reference plane or curve in a direction away from the airfoil tip and toward the groove base. In another embodiment, an "upstream beginning" of the cutback is understood to be the axial position beyond which the airfoil-side end face or upper edge of the web deviates from the straight reference plane or curve in the radial direction toward the groove base by at least 1%, in particular at least 5%, of a maximum radial distance between the groove base and a groove edge that is closer to the airfoil tip.

In an embodiment, the upstream beginning of the cutback is located downstream of the upstream groove edge and upstream of the upstream leading edge of the airfoil tip. In one embodiment, the airfoil-side end face (or, in one or more meridional sections, preferably all meridional sections, through the airfoil-tip-side end face of the web, the upper edge) of the web continues the flow duct contour to the beginning of the cutback with a continuous curvature; i.e., without abrupt changes in the curvature.

Correspondingly, in one embodiment, a "downstream end" of the cutback is understood to be the axial position at which the airfoil-side end face or upper edge of the web merges back into the reference plane or curve or into the downstream groove flank. In another embodiment, a "downstream end" of the cutback is understood to be the axial position beyond which the airfoil-side end face or upper edge of the web once again deviates from the straight reference plane or curve in the radial direction toward the groove base by less than 5%, in particular less than 1%, of a maximum radial distance between the groove base and the groove edge that is closer to the airfoil tip.

In an embodiment, the downstream end of the cutback is located in an airfoil-tip-proximal half of a radial height of the circumferential groove. In the context of the present invention, a "radial height" of the circumferential groove is understood to be in particular a maximum distance between the groove base and the reference plane or curve; i.e., in particular, a maximum distance between the groove base and the groove edge that is closer to the airfoil tip, in the radial direction or a direction perpendicular to the connecting line between the upstream and downstream groove edges. Such a distance perpendicular to the connecting line may also be referred to in a generalized way as a radial height of the circumferential groove.

In one embodiment, the radial cutback ends in the reference plane or curve; in a refinement axially upstream or downstream of the upstream leading edge of the airfoil tip. In one embodiment, the airfoil-side end face (or, in one or more meridional sections, preferably all meridional sections, through the airfoil-tip-side end face of the web, the upper edge) of the web continues the flow duct contour in an upstream direction from the downstream groove edge to the end of the cutback with a continuous curvature; i.e., without abrupt changes in the curvature.

In another embodiment, the radial cutback ends in the radially upper half of the downstream groove flank, and the web is continuously cut back radially, starting at the beginning of the cutback. The term "radially upper half" is used in a generalized way to refer to the portion of the downstream groove flank that extends in the radial direction or a direction perpendicular to the connecting line between the upstream and downstream groove edges over 50% of the maximum distance of the downstream groove edge from the groove base in this direction.

In one embodiment, the web merges into the upstream flank and/or the downstream flank of the circumferential groove, and thus may in particular extend axially through the groove or the maximum axial length thereof.

In this case, in one or more meridional sections, in particular all meridional sections, through the airfoil-tip-side end face of the web, as described earlier herein, an airfoil-tip-side upper edge of the web may, at the upstream groove edge, have the same curvature as the flow duct contour; i.e., at the upstream groove edge, it may have a continuous curvature and smoothly continue this curvature to the beginning of the cutback.

In a developed view, the web may be straight or curved; i.e., extend in a straight or curved manner. In particular, in one embodiment, the airfoil-side end face of the web may merge at least substantially axially with the upstream groove edge. In addition or alternatively, the airfoil-side end face may merge into the downstream groove flank with a curvature in or opposite to a direction of rotation of the airfoil tip.

Preferably, the area of the cutback in at least one meridional section is limited to no more than 30%, in particular no more than 25%, of the cross-sectional area of the circumferential groove. Accordingly, in one embodiment, in one or more meridional sections, in particular all meridional sections, through the airfoil-tip-side end face of the web, the web has a cross-sectional area which is at least 70%, in particular at least 75%, of the cross-sectional area of the circumferential groove in this meridional section. According to the above definition, a cross-sectional area of the circumferential groove is the area which, in a meridional section, is defined by the groove base, the groove flanks and a straight connecting line between the upstream and downstream groove edges.

In one embodiment, in one or more meridional sections, in particular all meridional sections, through the airfoil-tip-side end face of the web, the circumferential groove forms an angle of between 60° and 90° with the flow duct wall at the upstream groove edge. This makes it possible in particular to produce an advantageous axial undercut.

In one embodiment, an axial distance between the upstream groove edge and the leading edge of the airfoil tip disposed downstream thereof is greater than an axial distance between the downstream groove edge and the leading edge of the airfoil tip disposed upstream thereof. In other words, the leading edge of the airfoil tip is located between the upstream and downstream groove edges and is closer to the downstream groove edge.

In one embodiment, an axial distance between the upstream and downstream groove edges is at least 25% of an axial distance between the upstream leading edge and the downstream trailing edge of the airfoil tip.

In a section perpendicular to an axis of rotation of the compressor, the web may be straight or curved. The web; i.e., its tangents, may extend radially or be inclined to the radial direction. Accordingly, in one embodiment, in one or more sections, in particular all sections, perpendicular to the axis of rotation of the compressor through the airfoil-tip-side end face of the web, the web is inclined toward the base of the circumferential groove in the direction of rotation of the airfoil tip, in particular by at least 25° and/or no more than 65° to the radial direction.

In an embodiment, dimensional specifications are based on a component temperature of 20° C. and/or on components without elastic deformation.

BRIEF DESCRIPTION OF THE DRAWINGS

Further advantageous refinements of the present invention will become apparent from the dependent claims and the following description of preferred embodiments.

To this end, the only drawing, FIG. 1, shows, in partially schematic form, a portion of a gas turbine compressor in accordance with one embodiment of the present invention in a meridional section.

DETAILED DESCRIPTION

FIG. 1 is a meridional cross section of a portion of a gas turbine compressor in accordance with one embodiment of the present invention; i.e., of a gas turbine compressor designed in accordance with one embodiment of the present invention. The meridional cross section contains the axis of rotation of the compressor (horizontal in FIG. 1). The vertical direction in FIG. 1 is a radial direction.

The gas turbine compressor includes rotor blades arranged adjacent one another in the circumferential direction (perpendicular to the plane of the drawing of FIG. 1) and having shroudless tips, and a flow duct wall 20 disposed outwardly thereof and opposite thereto and fixed relative to the casing, one rotor blade tip 10 being partially shown in the meridional section of FIG. 1.

The flow duct wall has a circumferential groove formed therein, the circumferential groove having an upstream flank 31 which merges into the flow duct wall at an upstream groove edge 21, a downstream flank 32 which merges into the flow duct wall at a downstream groove edge 22, and a groove base 33 connecting these groove flanks.

The upstream groove flank has an axial undercut whose cross-sectional area in the meridional section is less than 10% of a cross-sectional area of the circumferential groove between its upstream and downstream groove edges. This cross-sectional area of the circumferential groove between its upstream and downstream groove edges is the area which, in the meridional section of FIG. 1, is defined by the groove base, a straight connecting line 24 between the upstream and downstream groove edges, and perpendicular lines through the upstream and downstream groove edges, which are indicated by dot-dash lines in FIG. 1. Accordingly, the cross-sectional area of the undercut is the area between upstream groove flank 31 and the dot-dash line perpendicular to connecting line 24 on the left in FIG. 1.

A plurality of webs are arranged in the circumferential groove and spaced apart in the circumferential direction (perpendicular to the plane of the drawing of FIG. 1), of which one web 40 is shown in cross-section in the meridional section of FIG. 1.

As explained earlier herein, reference numeral 24 in FIG. 1 denotes a straight connecting line 24 between upstream and downstream groove edges 21, 22. Thus, this line represents a reference curve which extends from the upstream groove edge to the downstream groove edge and whose curvature is infinite.

Reference numeral 23 in FIG. 1 denotes another reference curve which also extends from the upstream groove edge to the downstream groove edge, but whose curvature at the upstream and downstream groove edges is in each case equal to the curvature of the flow duct wall and axially continuously linear therebetween; i.e., linearly interpolates the curvature of flow duct wall 20 between groove edges 21, 22. Thus, this reference curve 23 represents a virtual extension of flow duct contour 20 across the circumferential groove.

In the meridional section of FIG. 1 through an airfoil-tip-side end face or upper edge 43 of web 40, reference curves 23, 24 each represent a corresponding circumferentially extending reference plane 23, 24.

As can be seen in the meridional section of FIG. 1, the airfoil-tip-side end face or upper edge 43 deviates from reference curve or plane 23; i.e., from the virtual extension of the flow duct contour, in a direction away from the airfoil tip and toward the groove base (upward in FIG. 1), starting at a point or circumferential line 41 up to another point or circumferential line 42.

Furthermore, starting at the point or circumferential line 41, the airfoil-side end face or upper edge 43 deviates from reference plane or curve 24 toward the groove base by at least 1% of a maximum radial distance between groove base 33 and groove edge 22 (i.e., the one closer to the airfoil tip).

Thus, the point or circumferential line 41 defines an upstream beginning of a radial cutback 44 of the web.

The airfoil-side end face or upper edge of the web continues flow duct contour 20 to this beginning 41 of cutback 44 with a continuous curvature.

The point or circumferential line 42 defines a downstream end of radial cutback 44, where the airfoil-side end face or upper edge 43 of the web merges into downstream groove flank 32.

In a modification (not shown), the airfoil-side end face or upper edge 43 of the web merges back into reference plane or curve 23. In this case, the point or circumferential line where the airfoil-side end face or upper edge 43 of the web merges back into reference plane or curve 23, or the point or circumferential line beyond which the airfoil-side end face or upper edge of the web once again deviates from the straight reference plane or curve 24 toward groove base 33 by less than 1% of the maximum radial distance between groove base 33 and groove edge 22 (i.e., the one closer to the airfoil tip) represents the downstream end of the radial cutback.

In this modification (not shown), the airfoil-side end face or upper edge of the web may continue the flow duct contour with a continuous curvature from downstream groove edge 22 in an upstream direction (toward the left in FIG. 1) to this end of the cutback, as described and illustrated analogously for the region between upstream groove edge 21 and upstream beginning 41 of the cutback.

Thus, the empty space or the free area between the airfoil-side end face or upper edge 43 of the web and reference plane or curve 23 defines radial cutback 44 with its upstream beginning 41 and its downstream end 42.

As can be seen in the meridional section of FIG. 1, this upstream beginning 41 of cutback 44 is located axially downstream (to the right in FIG. 1) of upstream groove edge 21 between this groove edge 21 and upstream leading edge 11 of airfoil tip 10, and downstream end 42 of cutback 44 is located in an airfoil-tip-proximal half 34 of a radial height 35 of the circumferential groove.

The radial height may be defined as the maximum distance between groove base 33 and groove edge 22 (i.e., the one closer to the airfoil tip) in the radial direction (vertical in FIG. 1) or, as indicated in FIG. 1, the maximum distance 35 between groove base 33 and groove edge 22 (i.e., the one closer to the airfoil tip) in a direction perpendicular to the straight connecting line 24 between the upstream and downstream groove edges.

In the embodiment shown, the radial cutback ends in the radially upper half 34 of downstream groove flank 32, and the web is continuously cut back radially, starting at beginning 41. The term "radially upper half" is used to refer to the portion or region of downstream groove flank 32 that extends in the radial direction or a direction perpendicular to connecting line 24 between the upstream and downstream groove edges over 50% of the maximum distance of downstream groove edge 22 from groove base 33 in this direction.

In the embodiment of FIG. 1, web 40 merges into the upstream and downstream flanks 31, 32 of the circumferential groove, and thus extends axially through the groove.

As explained earlier herein, the airfoil-tip-side end face or upper edge of the web has, at upstream groove edge 21, the same curvature as flow duct contour 20 and smoothly continues this curvature to beginning 41 of cutback 44.

In the embodiment of FIG. 1, web 40 has a cross-sectional area (shown hatched in FIG. 1) which is at least 75% of the cross-sectional area of the circumferential groove in this meridional section, which is defined by groove flanks 31, 32, groove base 33, and connecting line 24 between the two groove edges 21, 22.

In the embodiment of FIG. 1, the circumferential groove forms an angle α of between 60° and 90° with flow duct wall 20 at upstream groove edge 21.

In the embodiment of FIG. 1, an axial distance between upstream groove edge 21 and leading edge 11 of airfoil tip 10 disposed downstream thereof (to the right in FIG. 1) is greater than an axial distance between downstream groove edge 22 and leading edge 11 disposed upstream thereof.

In the embodiment of FIG. 1, an axial distance between upstream and downstream groove edges 21, 22 is at least 25% of an axial distance between upstream leading edge 11 and a downstream trailing edge 12 of airfoil tip 10.

$S_{AX}$ schematically indicates an axial chord length of airfoil tip 10. This axial chord length may be equal to the axial distance between leading and trailing edges 11, 12 of airfoil tip 10 or also to the length of the chord line or camber line thereof.

An axial distance $L_{KOZ}$ between upstream beginning 41 of cutback 44 and upstream leading edge 11 of the airfoil tip is between 1% and 40%, preferably between 2% and 15%, of the so-defined chord length S.

An axial distance $L_{OL}$ between upstream leading edge 11 of the airfoil tip and downstream groove edge 22 is between 5% and 40%, preferably between 10% and 30%, of chord length $S_{AX}$.

An axial distance $\Delta_{45}$ between upstream leading edge 11 of the airfoil tip and a kink 45 in the airfoil-tip-side end face or upper edge 43 of the web in the cutback is no more than 10%, preferably no more than 5%, of chord length $S_{AX}$.

A radial distance between airfoil tip 10 and the airfoil-tip-side end face or upper edge 43 of the web in cutback 44 is between 50% and 1500%, preferably between 100% and 1000%, of a radial distance $H_{GAP}$ between airfoil tip 10 and the downstream groove edge 22 radially opposite thereto. The minimum radial distance $H_{KOZ}$ between airfoil tip 10 and the airfoil-tip-side end face or upper edge 43 is exemplarily indicated in FIG. 1. Likewise, a maximum distance or mean distance at leading edge 11 may also be taken as a basis.

Although the above is a description of exemplary embodiments, it should be noted that many modifications are possible. It should also be appreciated that the exemplary embodiments are only examples, and are not intended to limit the scope, applicability, or configuration in any way. Rather, the foregoing detailed description provides those skilled in the art with a convenient road map for implementing at least one exemplary embodiment, it being understood that various changes may be made in the function and arrangement of elements described without departing from the scope of protection as set forth in the appended claims or derived from combinations of features equivalent thereto.

LIST OF REFERENCE NUMERALS

10 airfoil tip
11 leading edge
12 trailing edge
20 flow duct contour
21 upstream groove edge
22 downstream groove edge
23 reference plane/curve
24 straight reference plane/curve
31 upstream groove flank
32 downstream groove flank
33 groove base
34 airfoil-tip-proximal half of the circumferential groove
35 radial height of the circumferential groove
40 web
41 upstream beginning of the cutback
42 downstream end of the cutback
43 airfoil-tip-side end face/upper edge
44 cutback
45 kink
α angle
$H_{KOZ}$ radial distance between airfoil tip and airfoil-tip-side end face/upper edge
$H_{GAP}$ radial distance between airfoil tip and downstream groove edge
$L_{KOZ}$ axial distance between beginning of cutback and airfoil tip leading edge
$L_{OL}$ axial distance between airfoil tip leading edge and downstream groove edge
$S_{AX}$ axial chord length
$\Delta_{45}$ axial distance between kink and airfoil tip leading edge

What is claimed is:

1. A gas turbine compressor comprising:

at least one airfoil tip having an upstream leading edge and a downstream trailing edge; and a flow duct wall disposed radially opposite to the airfoil tip and having a circumferential groove having an upstream groove edge and a downstream groove edge, the circumferential groove having disposed therein at least one web having a radial cutback, wherein, in at least one meridional section through an airfoil-tip-side end face of the web, an axial distance ($L_{KOZ}$) between an upstream beginning of the cutback of the web and the upstream leading edge of the airfoil tip is at least 1% and no more than 40% of a chord length between the upstream leading edge and the downstream trailing edge of the airfoil tip or an axial distance ($\Delta_{45}$) between the upstream leading edge of the airfoil tip and a kink in an airfoil-tip-side upper edge of the web in the cutback is no more than 10% of the chord length between the upstream leading edge and the downstream trailing edge of the airfoil tip.

2. The gas turbine compressor as recited in claim 1 wherein the upstream beginning of the cutback is located axially downstream of the upstream groove edge between the upstream groove edge and the upstream leading edge of the airfoil tip or a downstream end of the cutback is located in an airfoil-tip-proximal half of a radial height of the circumferential groove.

3. The gas turbine compressor as recited in claim 1 wherein in the at least one meridional section, the airfoil-tip-side upper edge of the web has a continuous curvature at the upstream groove edge; or wherein an airfoil-side end face of the web merges axially with the upstream groove edge or merges into a downstream groove flank with a curvature in or opposite to a direction of rotation of the airfoil tip.

4. The gas turbine compressor as recited in claim 3 wherein the airfoil-tip-side upper edge of the web has the continuous curvature at the upstream groove edge up to a beginning of the cutback.

5. The gas turbine compressor as recited in claim 1 wherein the web merges into an upstream or a downstream groove flank of the circumferential groove or, in the at least one meridional section, has a cross-sectional area which is at least 70% of a cross-sectional area of the circumferential groove.

6. The gas turbine compressor as recited in claim 5 wherein the cross-sectional area of the web is at least 75% of the cross-sectional area of the circumferential groove.

7. The gas turbine compressor as recited in claim 1 wherein the circumferential groove extends through the full circumference of the flow duct wall or, in the at least one meridional section, forms an angle ($\alpha$) of between 60° and 90° with the flow duct wall at the upstream groove edge.

8. The gas turbine compressor as recited in claim 1 wherein an axial distance between the upstream groove edge and the leading edge of the airfoil tip disposed downstream thereof is greater than an axial distance between the downstream groove edge and the leading edge of the airfoil tip disposed upstream thereof; or wherein an axial distance between upstream and downstream groove edges is at least 25% of an axial distance between the upstream leading edge and the downstream trailing edge of the airfoil tip.

9. The gas turbine compressor as recited in claim 1 wherein in at least one section perpendicular to an axis of rotation of the compressor, the web is inclined toward a groove base of the circumferential groove in the direction of rotation of the airfoil tip; or wherein at least three identical or different webs are arranged in the circumferential groove and spaced equidistantly or at varying intervals apart in the circumferential direction.

10. The gas turbine compressor as recited in claim 9 wherein the web is inclined toward the groove base of the circumferential groove in the direction of rotation of the airfoil tip by at least 25° or no more than 65° to a radial direction.

11. The gas turbine compressor as recited in claim 1 wherein the airfoil tip is a radially outer tip of a rotor blade, and the flow duct wall is located radially outwardly thereof and opposite thereto or a radially inner tip of a stator vane, and the flow duct wall is located radially inwardly of the stator vane and opposite to the stator vane.

12. The gas turbine compressor as recited in claim 1 wherein an upstream groove flank or a downstream groove flank of the circumferential groove has an axial undercut whose cross-sectional area in the at least one meridional section is less than 10% of a cross-sectional area of the circumferential groove between upstream and downstream groove edges.

13. The gas turbine compressor as recited in claim 1 wherein, in the at least one meridional section through the airfoil-tip-side end face of the web, the axial distance ($L_{KOZ}$) between the upstream beginning of the cutback and the upstream leading edge of the airfoil tip is at least 1% and no more than 40% of the chord length between the upstream leading edge and the downstream trailing edge of the airfoil tip.

14. The gas turbine compressor as recited in claim 1 wherein, in the at least one meridional section through the airfoil-tip-side end face of the web, the axial distance between the upstream leading edge of the airfoil tip and the downstream groove edge is at least 5% and no more than 40% of the chord length between the upstream leading edge and the downstream trailing edge of the airfoil tip.

15. The gas turbine compressor as recited in claim 1 wherein, in the at least one meridional section through the airfoil-tip-side end face of the web, the axial distance ($\Delta_{45}$) between the upstream leading edge of the airfoil tip and the kink in the airfoil-tip-side upper edge of the web in the cutback is no more than 10% of the chord length between the upstream leading edge and the downstream trailing edge of the airfoil tip.

16. The gas turbine compressor as recited in claim 1 wherein, in the at least one meridional section through the airfoil-tip-side end face of the web, a radial distance ($H_{KOZ}$) between the airfoil tip and the airfoil-tip-side upper edge of the web in the cutback is at least 50% and no more than 1500% of a radial distance ($H_{GAP}$) between the airfoil tip and the downstream groove edge radially opposite thereto.

17. An aircraft engine comprising the gas turbine compressor as recited in claim 1.

18. A method for designing the gas turbine compressor as recited in claim 1, the method comprising:

selecting, in the at least one meridional section, the axial distance ($L_{KOZ}$) between the upstream beginning of the cutback and the upstream leading edge of the airfoil tip to be at least 1% and no more than 40% of thechord length between the upstream leading edge and the downstream trailing edge of the airfoil tip; or selecting the axial distance ($\Delta_{45}$) between the upstream leading edge of the airfoil tip and the kink in the airfoil-tip-side upper edge of the web in the cutback to be no more than 10% of the chord length between the upstream leading edge and the downstream trailing edge of the airfoil tip.

* * * * *